United States Patent [19]

Cole et al.

[11] Patent Number: 4,972,571

[45] Date of Patent: Nov. 27, 1990

[54] METHOD OF MAKING A LADDER

[75] Inventors: Paul E. Cole, Masury, Ohio; Brian R. Fisher, Greenville, Pa.

[73] Assignee: R. D. Werner Co., Inc., Greenville, Pa.

[21] Appl. No.: 681,390

[22] Filed: Dec. 10, 1984

[51] Int. Cl.[5] ..... B21D 39/00

[52] U.S. Cl. ..... 29/523; 29/512

[58] Field of Search ..... 29/523, 512, 509, 453

[56] References Cited

U.S. PATENT DOCUMENTS

| | | | |
|---|---|---|---|
| 3,119,435 | 1/1964 | Greenman | 29/512 |
| 3,481,026 | 12/1969 | Lindesmith et al. | 29/523 |
| 4,100,668 | 7/1978 | Ruff et al. | 29/523 |

*Primary Examiner*—Howard N. Goldberg
*Assistant Examiner*—Irene Cuda
*Attorney, Agent, or Firm*—J. Helen Slough

[57] ABSTRACT

Ladder constructions and methods of forming the same wherein box-type or tubular rails are employed. The rung-to-rail connection or joint is formed by providing an opening in one of the rail side walls and an aligned clearance hole in the opposite rail side wall to afford an opening through which a swaging tool is projected and forms an annulus in tight engagement into the inner surfaces surrounding the opening in the first named rail side wall, cooperating swaging means forming an annulus on the outer surfaces surrounding the said opening. A ladder having tubular side rails is hence provided with a rail-to-rung joint on one of the walls by projecting a swaging tool through a clearance hole in an opposite wall. The clearance hole is adapted to be closed by placing a plug in the same and in the event the clearance hole is in the innermost side rail the rung is adapted to be used to close the space provided by the opening in the rail between the rung and one of the side rails.

3 Claims, 2 Drawing Sheets

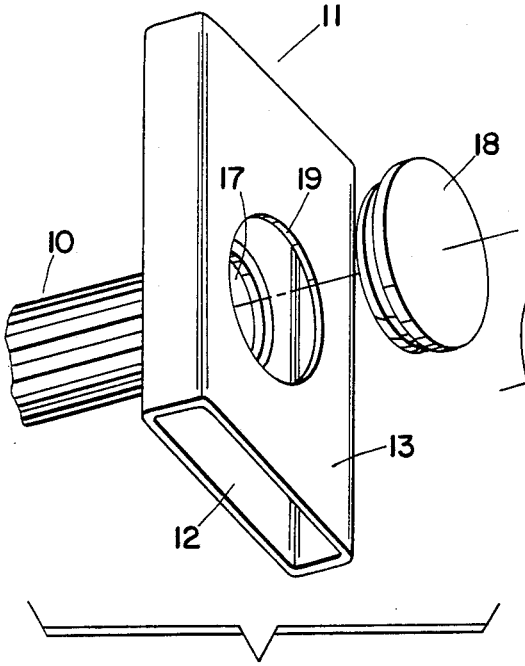
Fig. 1
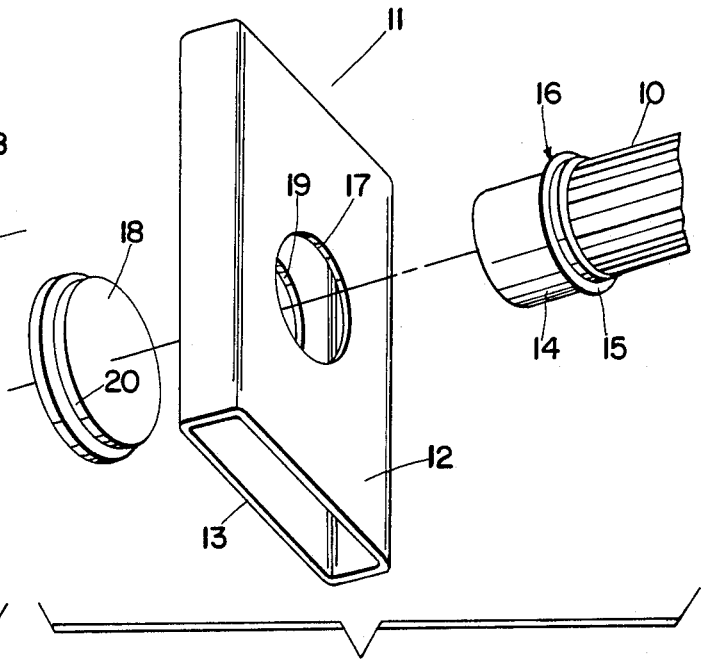
Fig. 2
Fig. 5
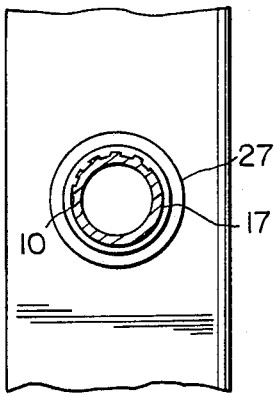
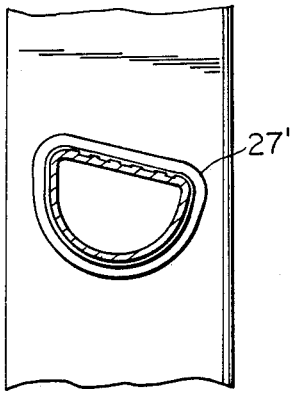
Fig. 6
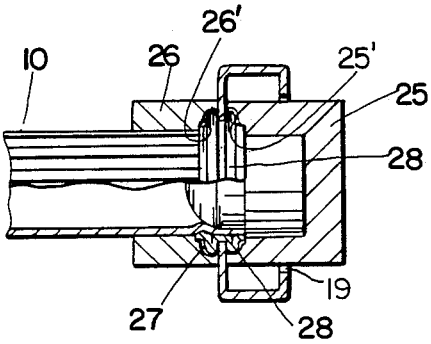
Fig. 3
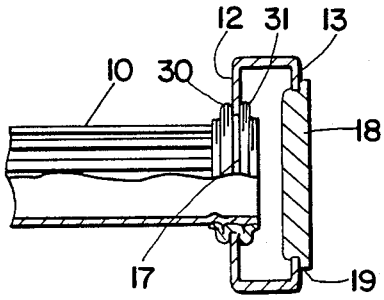
Fig. 4

METHOD OF MAKING A LADDER

The present invention relates to ladders and method of making ladders and relates more particularly to a method of making a ladder having a rung, box-section side rails and ferrules adapted to be disposed over an end of the ladder rung the ferrule and rung being projected through aligned openings in opposite sides of the rail and means to secure the rung to one side of the rail and to produce a joint which is secure and twist-resistant.

In the past the assignee of the present inventors secured Stoyer U.S. Pat. No. 3,039,186 covering a three part rung-to-rail joint assembly for ladders wherein a ferrule was slidably telescoped over an end of the rung, the inner diameter of the ferrule being slightly smaller than the outer diameter of the rung to provide a frictional fit between the ferrule and the rung. The assembly was then projected through an opening in a side rail and aligned with respect to forming die members for gripping the rung and ferrule assembly and for endwise swaging of the ferrule causing a flow of the malleable metal of the ferrule radially-outwardly into compression engagement within and in a side-running flow along both sides of the associated wall edge portions of the opening in the side rail. In addition the ferrule metal flowed slightly radially inwardly into the outer surface of the rung. The invention was disclosed as employed with channel-shaped side rails.

Subsequently thereto the said assignee secured U.S. Pat. No. 3,477,120 on an improvement over the Stoyer patent, the improvement comprising the making of a three part joint assembly of the type referred to which involved preforming of a radially outwardly extending annulus or flange on one end of the ferrule prior to sliding the ferrule on the rung and flowing metal of the ferrule on an opposite end thereof into tight engagement with the rail on an opposite side of the channel shaped rail.

Thereafter, the referred to assignee obtained U.S. Pat. Nos. 3,484,931 and 3,545,072 covering a method of shearing end portions of the ferrule to form flanges on opposite sides of the rail which tightly engage edge portions of the rail around an aperture therein and U.S. Pat. No. 3,500,936 covering the ladder construction resulting therefrom.

Another three part ferrule, rung and rail construction is shown in U.S. Pat. No. 3,528,525 to the aforesaid assignee, which discloses nodes on the ferrule folded outwardly on either side of the rail web surrounding an opening in said rail. The method of joining the same is disclosed in U.S. Pat. No. 3,481,026.

In the present invention the methods of forming the three part ferrule, rung and rail assemblies as set forth in the above referred to patents may be employed with box-like or tubular rail members having opposite side walls provided with substantially aligned openings and the ferrules are provided with flanges surrounding opposite sides of one of the rail walls around the opening therein. One flange of the ferrule may be preformed as shown in U.S. Pat. No. 3,477,120 and caused to abut surfaces surrounding said opening on one side of the wall, and an opposite flange may be formed as taught by Stoyer or provided with a node as shown in U.S. Pat. No. 3,528,525 or sheared as shown in U.S. Pat. No. 3,500,936 and caused to abut the opposite side of the said wall or web. The ferrule may also, in the event a preformed flange is not employed, be provided with flanges on either side of the opposite spaced walls of the rail in accordance with any of the above said patents.

In the drawings:

FIG. 1 is a fragmentary exploded perspective view of a ladder rung and rail assembly, the rail being a box-type rail, the rung and rail assembly secured to the inner web of the rail and a clearance plug shown for projection into an opening in an opposite web of the rail;

FIG. 2 is a view similar to FIG. 1 showing the rung and ferrule assembly, for projection through aligned openings in the pair of spaced webs disposed on opposite sides of the rail; the ferrule being provided with a preformed flange on one end of the ferrule;

Figure 7:
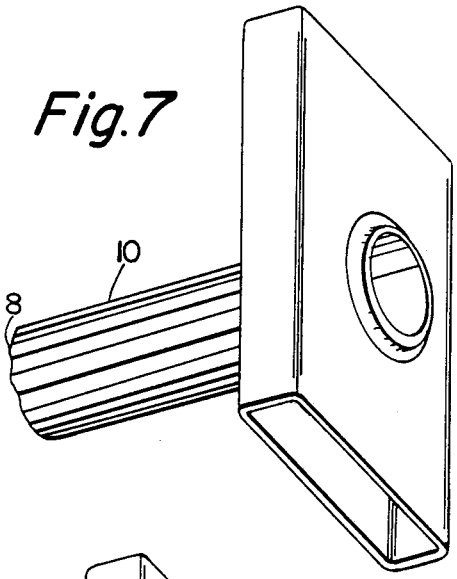
Figure 9:
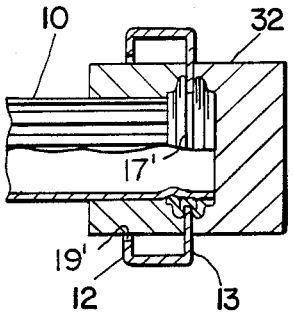
Figure 10:
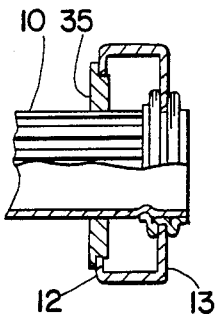
Figure 8:
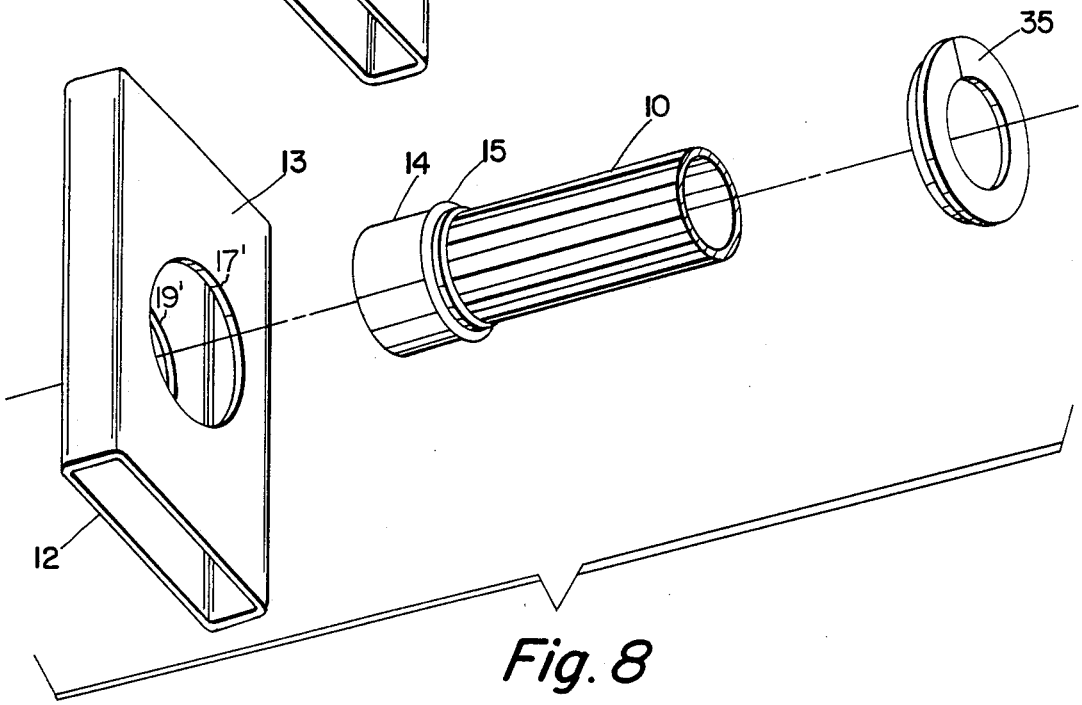
Figure 11:
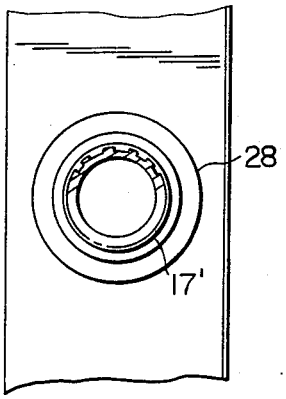
Figure 12:
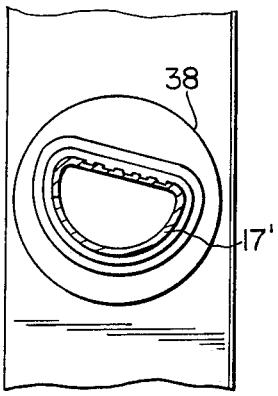

FIG. 3 is a fragmentary sectional view of the rung and ferrule with a pair of swaging die members, in closed position, one of said dies being a split die operating on the web of the inner side of the rail and one being a solid die operating through the web of the outer side of the rail and extending through the clearance hole in the said side; the solid die having a pilot member projecting inwardly of the open end of the rung;

FIG. 4 is a view similar to that of FIG. 3 but showing the rung-to-rail assembly of FIG. 3 disposed in a web of the inner side of the rail and showing a plug disposed in a clearance hole on the other or outer side of the rail;

FIG. 5 is a fragmentary view of the rung-to-rail assembly of FIG. 4 showing a rung and ferrule of circular or round configuration;

FIG. 6 is a view similar to that of FIG. 5 but showing the rung and ferrule of D-shaped configuration;

FIG. 7 is a fragmentary perspective view of a second embodiment of our invention showing the rung-to-rail joint disposed on the outer wall of a box-type rail;

FIG. 8 is a fragmentary exploded view of the rung and ferrule assembly having a flange preformed thereon and the rail and plug;

FIG. 9 is a sectional view similar to that of FIG. 3 showing the forming or swaging die members in closed position about the outer rail forming a rung-to-rail joint thereon;

FIG. 10 is a sectional view of the assembled joint of FIG. 9, the dies being withdrawn, and showing an apertured rail clearance hole plug inserted in the clearance hole in the inner web of the rail surrounding the rung;

FIGS. 11 and 12 are similar to FIGS. 5 and 6 and are views illustrating the shape of the clearance hole as round or D-shaped and the plug as round;

Referring now to the drawings and referring more particularly to FIGS. 1 to 5 inclusive, at 10 is shown a rung and ferrule 14, the ferrule being telescoped over the rung to form a rung and ferrule assembly 16 of aluminum or the like metal which is adapted to be secured to a ladder rail 11 to form a rung-to-rail joint. The rail as shown is tubular or box-like and is provided with an inner and outer web 12 and 13, each web having substantially aligned openings 17 and 19 therein. The rung 10 as shown is provided with radially outwardly extending ribs 8. The ferrule 14 is of malleable metal material and is provided, in the form shown, with a preformed annulus or flange 15 adjacent one end thereof, which preformed annulus is adapted to tightly engage peripheral outer surfaces surrounding the opening 17. The ferrule 14 is adapted to be press-fit on the end of the rung and preferably the inner diameter thereof is slightly smaller than the outer diameter of the rung to afford a tight telescoped fit thereover.

The rung and ferrule assembly 16 referred to is adapted to be projected through either the clearance opening 17 in the inner web 12 of the rail, as shown in FIG. 1, and the preformed flange 15 adapted to abut the outer surfaces of the web 12 of the rail, to provide a rung-to-rail connection with the inner web 12 of the rail or through the opening 17 in the inner web of the rail as shown in FIGS. 9 and 10 with the flange 15 abutting the outer web of the rail side wall 13 to provide a rung-to-rail joint connection with the rail. A circular lid or plug 18 is of a size and shape adapted to be snapped into or otherwise securely mounted within the opening 19 in the outer web 13 of the rail as shown in FIG. 4 or into the clearance opening 17 in the inner web of the rail 12 to close the die clearance opening 17, as shown in FIG. 10.

Prior to the placement of the plug 18 in the clearance opening 19 or the plug 35 having a circular opening therein in the clearance opening 17 to close the same, the free unflanged end or ends of the ferrule are swaged as described herein to form flanges 27 and 28 or 15 and 28 on opposite sides of the web of one side of the rail.

In the form of FIGS. 1 to 4, the solid swaging die 25 and horizontally split die 26 in alignment with the rung and ferrule assembly 16 are in each form of the invention then caused to be moved axially inwardly, causing metal on the free or opposite end of the ferrule to be formed within cavities 26' and 25' to flow around inner surfaces of the web 12 surrounding the opening 17 to form an annulus tightly engaging said surfaces. The preformed annulus if employed is during the swaging thereof rightly engaged within the cavity surfaces 26' of the inner web 12 surrounding the opening 17 and acts as back-up or reinforcement during the forming of the annulus or flange on the opposite free end of the ferrule within the die cavity 25'. In the event an unflanged ferrule is employed, the dies 25 and 26 operate on the opposite ends of the ferrule to form the metal on the other end thereof into annuli disposed on either side of the side wall of the rail. The plug 18, as shown in FIGS. 1, 2 and 4, is of a shape and size so as to be easily snapped into the clearance opening to close the same thereby eliminating any "whistling" of the ladder which would take place if the opening were not closed and the ladder was being transported by a vehicle over a highway. The plug also enhances the appearance of the ladder. As shown in the form of FIGS. 1 and 2 the plug is provided with a stepped portion 20 which tightly engages the peripheral edges of the rail surrounding the clearance hole 19. As shown in FIG. 10 the plug 35 tightly encases the rung and is frictionally engaged within the opening 17 in the inner wall side of the rail.

It is to be noted that the rail clearance hole plug 35 used to close the outside web 13 as shown in FIG. 10, enables any tendency of the rung to bend under use to be transferred to the inner web of the side rail and makes the entire ladder stiffer and stronger. Further it is to be noted that the openings 17 and 17' can optionally be either an oversized round opening as in FIGS. 5, 11, and 12 or of any shape conforming to the rung cross-section, as, for example, D-shape as shown in FIG. 6 and 12 and the openings 19 and 19' function as a clearance hole.

In the form of FIGS. 7 to 10 inclusive where the rung-to-rail joint is formed on the outer web of the rail, the swaging is accomplished in the manner of FIGS. 3 and 4 and the ferrule-rung assembly is projected through the clearance hole 19'. If a preformed annulus 15 is provided, as shown in FIG. 8, the ferrule-rung assembly is projected through the opening 17' in this form of the invention and the preformed annulus 15 is caused to abut the outer peripheral surfaces surrounding the opening 17' in the web of the outer rail 13 and the swaging dies, as shown in FIG. 9, enclose the preformed annulus 15 and a flange 27 is formed on the opposite end of the ferrule by flowing metal around the inner peripheral surfaces of the web 13 surrounding the opening 17' which, in this form of the invention, is disclosed as smaller than the clearance opening 19' which receives the apertured plug 35.

In the event the ferrule 14 is not provided with a preformed annulus 15 or 38 as shown in U.S. Pat. No. 3,477,120, prior to its insertion into the rail, the dies 25, 26 as stated cause the metal on either end of the ferrule to flow into the respective cavities in the dies thus forming an annulus 27, 28 at either of the opposite ends of the ferrule 14, the ferrule being thus adapted to tightly engage both inner and outer surfaces of the rail surrounding an opening in either the outer or inner web of the rail, as shown and the rung of the said annuli may be formed either simultaneously or sequentially by utilizing the method of any of the patents referred to.

In this invention wherever the terms "rail", "rail side walls", or "web of the rail" or the like are employed, the same is applicable not only to tubular or box-like rails as shown herein, but also to rung plates or brackets secured to the rail.

While the invention herein has been described in connection with certain preferred embodiments, it is to be understood that numerous and extensive departures may be made therein and applications to structures other than ladders, without, however, departing from the spirit of the invention or the scope of the appended claims.

What we claim is:

1. A method of forming a rung-to-rail joint on a side wall of a box-type or tubular rail comprising:

(a) telescoping a ferrule over one end of a rung;

(b) inserting a portion of a free end of the assembled ferrule and rung through a first opening in one side wall of the rail in spaced relation to a clearance opening aligned with said first opening in an opposite side wall of the rail;

(c) projecting opposite of a pair of swaging tools disposed on opposite sides of the rail through the clearance opening in the one side wall of the rail said first tool forming a flange on one end of the assembled ferrule and rung and said first flange abutting the inner wall of the said side wall and the other pair of tools disposed on an outer side of the said side wall of the rail forming a flange on the ferrule surrounding the opening on the outer side of said wall;

(d) withdrawing the swaging tool from within the rail box;

(e) closing the clearance opening with a cover.

2. The method of claim 1 wherein the closing means is a solid plug adapted to be snapped into rimming engagement with the clearance opening.

3. The method of claim 1 wherein the closing means is an apertured disc adapted to be telescoped over the rung and secured within an opening in the rail surrounding the rung.

* * * * *

UNITED STATES PATENT AND TRADEMARK OFFICE

CERTIFICATE OF CORRECTION

PATENT NO. : 4,972,571

DATED : November 27, 1990

INVENTOR(S) : Paul E. Cole and Brian R. Fisher

It is certified that error appears in the above-identified patent and that said Letters Patent is hereby corrected as shown below:

Column 1, line 67, delete "3,500,936" and substitute --3,500,956--.

Column 2, line 49, delete ";" and substitute --.--.

Column 1, line 46, delete "3,500,936" and substitute --3,500,956--.

Signed and Sealed this

Nineteenth Day of May, 1992

*Attest:*

DOUGLAS B. COMER

*Attesting Officer*

*Acting Commissioner of Patents and Trademarks*